US008234733B1

(12) United States Patent
Fuss

(10) Patent No.: US 8,234,733 B1
(45) Date of Patent: Aug. 7, 2012

(54) PILLOW FOR SUPPORTING HEAD AND NECK

(76) Inventor: Edward J Fuss, Riverside, CT (US)

( * ) Notice: Subject to any disclaimer, the term of this patent is extended or adjusted under 35 U.S.C. 154(b) by 184 days.

(21) Appl. No.: 12/657,709

(22) Filed: Jan. 26, 2010

(51) Int. Cl.
*A47C 16/00* (2006.01)

(52) U.S. Cl. ..... 5/640; 5/637

(58) Field of Classification Search ..... 5/636, 637, 5/640, 645, 657; D6/382, 596, 601
See application file for complete search history.

(56) References Cited

U.S. PATENT DOCUMENTS 2,336,707 A * 12/1943 Thompson ..... 5/636
4,908,894 A * 3/1990 Sanders ..... 5/640

* cited by examiner

*Primary Examiner* — Robert G. Santos
*Assistant Examiner* — Nicholas Polito
(74) *Attorney, Agent, or Firm* — Patrick J. Walsh

(57) ABSTRACT

A sleeping pillow divided by a hinge web into head and neck sections, with a neck recess defining a neck roll formed in the neck section, and with the neck section moveable about web to hinged position with respect to a horizontal head section so that pillow supports a sleeper's head at the head section and neck on the neck roll.

5 Claims, 3 Drawing Sheets

PILLOW FOR SUPPORTING HEAD AND NECK

BACKGROUND OF THE INVENTION

The present invention is directed to pillows and in particular to pillows for sleeping comfort.

Pillows for sleeping typically consist of rectangular cover having a soft filling and outer pillow case for supporting the head positioned centrally of the rectangle. The primary object of such conventional pillows is to support a person's head such that his neck receives little or no support from the margin of the pillow.

The present invention provides a pillow for supporting head and neck, for improved sleeping comfort.

SUMMARY OF THE INVENTION

In accordance with the invention, a pillow comprises a generally rectangular casing divided along its long central axis into approximately equal head and neck support portions. A dividing hinge preferably sewn into the cover lies along the pillow axis effectively forms separate head and neck portions. The resulting head portion comprises a rectangular form of approximately one-half of the pillow, and the neck portion the other half. The neck portion is further defined by a neck recess in the form of a generally semi-circular contour extending into the neck support portion of the pillow from its outer long edge. The pillow cover so formed comprises a generally rectangular head portion attached by central hinge to a generally rectangular neck portion modified with a contoured neck recess. To complete the pillow, both head and neck portions are filled with soft pillow stuffing of various densities including soft, medium, and firm.

In use for sleeping, the pillow is folded along the hinge with the head rest portion being in a generally horizontal position, and the neck portion being generally pivoted from horizontal to a position anywhere from 0° to 180°. A sleeper's head lies directly on the head portion, while his neck lies in and is supported by the vertically positioned neck recess portion of the pillow.

The result is a pillow giving sleep comfort in a measure surpassing that of a conventional pillow.

Specific examples are included in the following description for purposes of clarity, but various details can be changed within the scope of the present invention.

OBJECTS OF THE INVENTION

It is an object of the invention to provide a pillow for supporting both head and neck while sleeping.

It is an object of the invention to provide a head and neck support pillow using the same materials as for conventional pillows with the same sizes.

Another object of the invention is to provide a pillow with head portion and neck portion connected by a hinge that keeps head and neck portions in fixed position to each other.

Another object of the invention is to provide a pillow for head and neck support that lies flat in the usual manner for pillows in a made bed, and which in use folds into horizontal head support and pivoted neck support sections for improved sleeping comfort.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
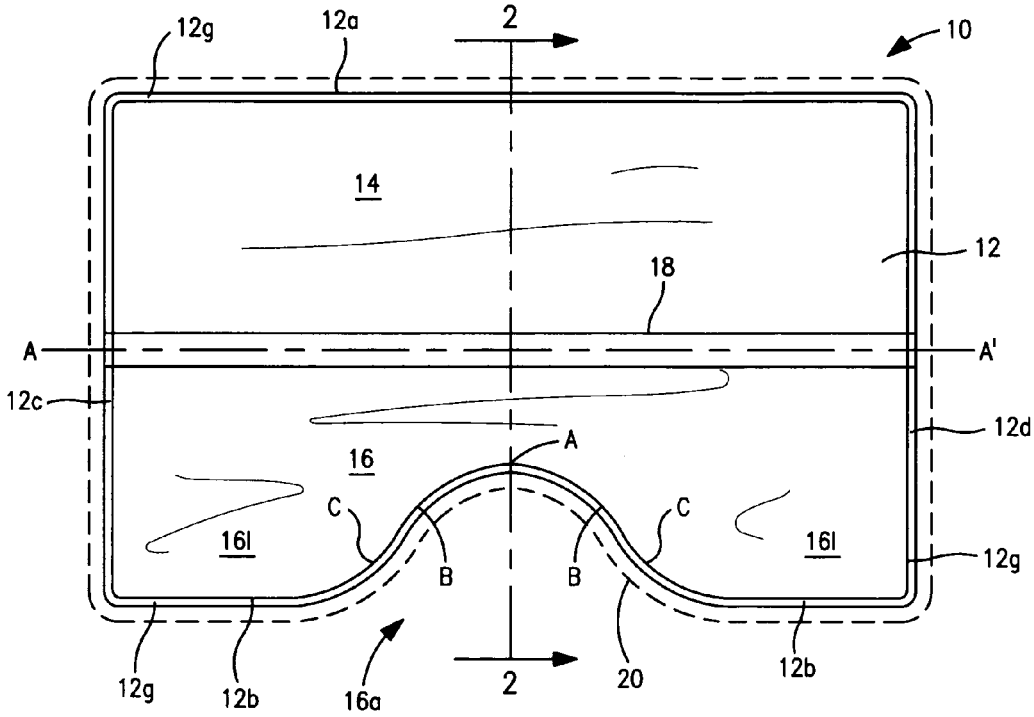
FIG. 1 is a plan view of a preferred embodiment of pillow according to the invention.

Referring now to the drawing, a pillow 10 according to the invention is generally rectangular and comprises a fabric cover of 100% cotton filled with a typical material such as polyester fiber filling or similar filler. The pillow cover has long sides 12*a-b* and short sides 12*c-d* of standard dimensions for bed pillows, e.g., a thirty inch long side, a twenty inch short side, and a thickness of approximately seven inches. The cover consists of upper and lower sheets 12*e-f* of the same size and shape attached to each other along their perimeter by fold lines or sewn seams 12*g* to form a pocket for receiving pillow filling. Ordinarily, one of the short sides remains open to receive pillow filling before being seamed.

The pillow cover is divided on the long axis A-A' into generally equal rectangular head 14 and neck 16 sections by means of a hinge web 18 sewn into the cover along axis. In preferred form, the hinge web is approximately three-eighths to one inch wide and is sewn into the pillow cover empty of filling. In practice, the width of the hinge may have a width of one stitch to one inch.

Figure 7:
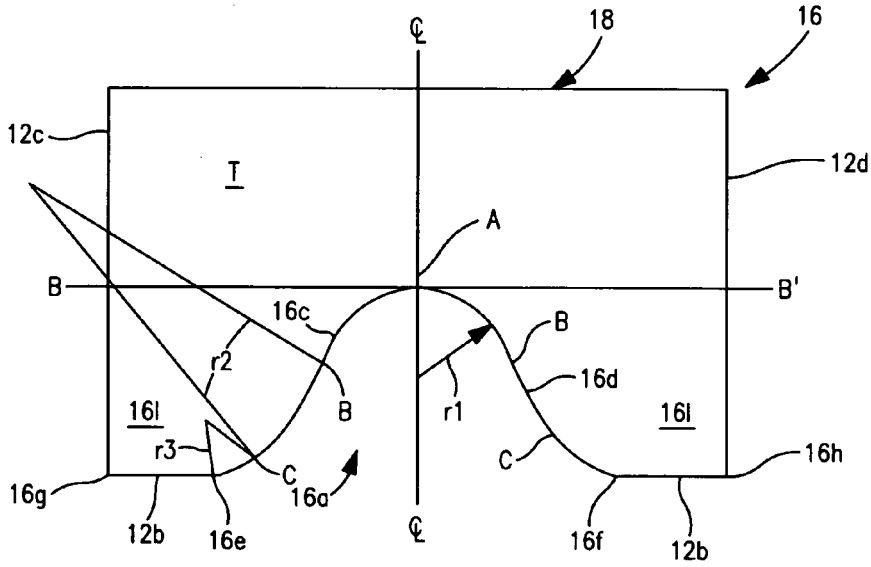
FIG. 7 is a template from which a pillow according to the invention is fabricated.

In accordance with the invention, a recess 16*a* is formed in the outer long margin 12*b* of the neck portion of the cover by which a sleeper's neck is supported by a filled pillow. The recess is formed by cutting away part of the cover and is defined with reference to apex A (FIGS. 1 and 7) located approximately one-half the depth (line B-B', FIG. 7) of the neck section between outer long margin 12*b* and the hinge web 18 and on centerline cl of the pillow. The recess 16*a* is further defined by symmetric arcuate lines 16*c-d* extending from the apex A to outer margin at points 16*e-f* approximately midway between centerline and side edge junctions 16*g-h*. A template T for fabricating a preferred embodiment of pillow cover according to the invention is shown in FIG. 7. The template is specific to the neck section 16 of a pillow cover. The recess 16*a* defines arcuate lines 16*c-d* symmetric of centerline beginning at apex A and comprising concave curve having radius $r_1$ of approximately three inches extending to point B and there joining convex curve with radius $r_2$ of approximately eight inches extending to point C and there joining convex curve with radius $r_3$ of approximately two inches and extending to a final point 16*e-f* joining outer edge 12*b*. The arcuate curve 16*c-d* formed in this way softens the contour of the neck recess to avoid cheek contact of sleeper. After being defined in this way, the recess line is sewn into the pillow cover with excess cover material trimmed away. Then the pillow cover is filled with polyester fiber or similar filling and its open end is sewn closed. The pillow now has a filled rectangular head section, and a filled neck section characterized in a neck roll 16*k* (FIG. 2) between outer neck lobes 16*l* occupying the space between the recess 16*a* and side margins 12*c-d* of the pillow.

Figure 2:
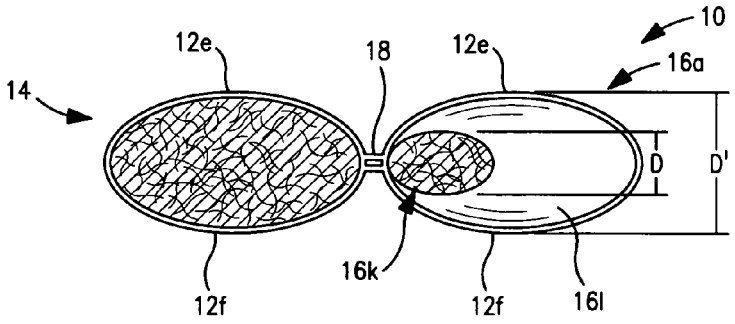
FIG. 2 is a section view taken along line 2-2 of FIG. 1.
Figure 3:
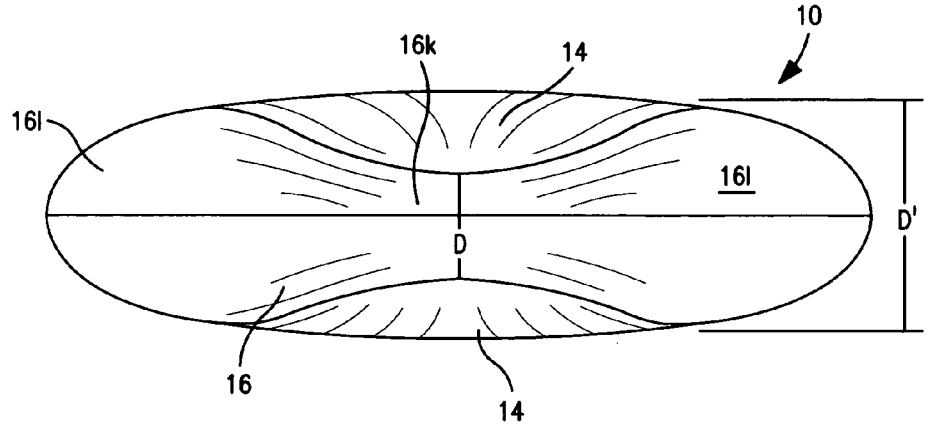
FIG. 3 is a front elevation view of the pillow of FIG. 1 showing neck portion.

It is to be understood that a pinched neck recess results in neck roll 16*k* as a consequence of seaming arcuate lines 16*c-d* and filling the neck section with fiber or filler material. The neck roll is seen in FIGS. 2 and 3 where depth or thickness D of neck roll is less than depth or thickness D' of lobes 16*l* of the neck section. The neck roll has a depth D approximately one-half to three-quarters the depth D' of the lobe portions of the neck section.

Figure 4:
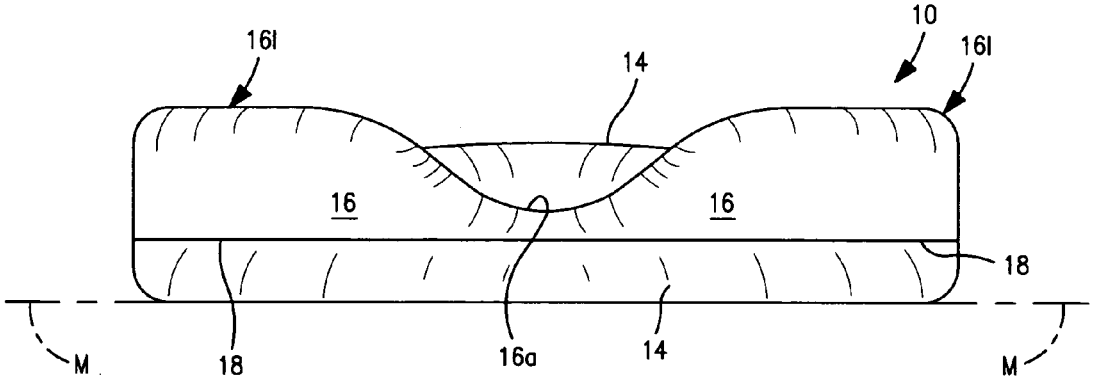
FIG. 4 is a front elevation view of the pillow of FIG. 1 with the neck section in vertical or pivoted position in foreground and head in horizontal position in background.
Figure 5:
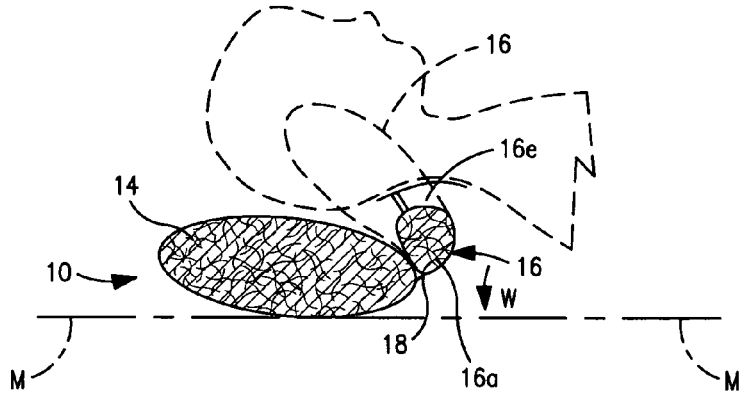
FIG. 5 is a schematic view of the pillow of FIG. 1 with generally horizontal head section and generally vertical neck portion in position to receive a sleeper's head and neck.
Figure 6:
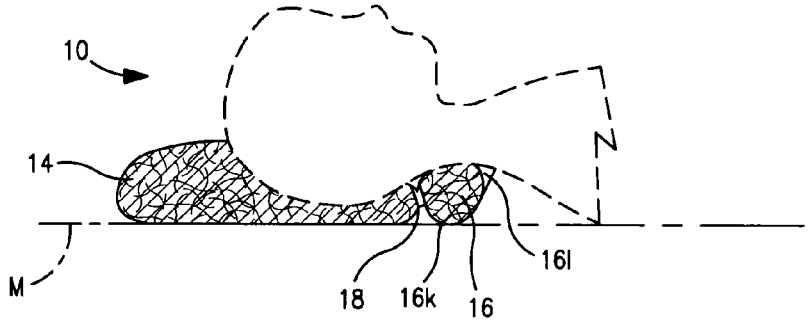
FIG. 6 is a schematic view of pillow and sleeper of FIG. 5 in sleeping position.

In use, as shown in FIGS. 4, 5, and 6, head section 14 lies flat on mattress M while the neck section 16 is hinged about web to assume a position anywhere from flat (0°) through 180° from flat position, and preferably in a range of 90° to 150° from flat position. A sleeper positions neck into the recess 16*a* of the pillow neck section engaging neck roll 16*k* and with head on the head section. FIG. 5 illustrates nominal juxtaposition of head and neck as the sleeper is lying down and moving in the direction of the arrow W. FIG. 6 illustrates final position of compact pillow with head resting on head section and neck resting on neck roll between lobes. FIGS. 5 and 6 show a sleeper in supine position with back of head on pillow. Alternatively, the sleeper may lie on his side with cheek engaging pillow.

As shown in FIG. 1, pillow case 20 may be contoured to match recess contour.

The term approximately for purposes of this application means plus or minus 10% of the values stated.

Various changes may be made to the structure embodying the principles of the invention. The foregoing embodiments are set forth in an illustrative and not in a limiting sense. The scope of the invention is defined by the claims appended hereto.

I claim:

1. A pillow for sleeping comprising a pillow cover having a generally rectangular shape defined by long edges and short edges, a longitudinal web sewn into the cover for dividing the cover into a generally equal head section and a neck section, the web providing a hinging action between head and neck sections in a way that the neck section is moveable from a horizontal to a hinged position of up to 180° and the head section remains horizontal, a neck recess in the neck section starting at spaced points on the long edge of the neck section and extending into the body of the neck section along arcuate lines to an apex, the neck recess defining neck lobes at the outer corners of the neck portion of the pillow cover, the neck recess further defining a neck roll between web and apex and between and between neck lobes, the neck roll being pinched by web and recess apex to a thickness less than that of the lobes, the neck roll together with the neck lobes attached along the longitudinal web to hinge with respect to the head section, the pillow cover being stuffed with filling to form a sleeping pillow whereby the neck portion of the pillow is moveable to hinged position to support a sleeper's neck positioned on the neck roll in the recess as the head portion remains horizontal to support a sleepers head.

2. A pillow for sleeping comprising a pillow cover having a generally rectangular shape defined by long edges and short edges, a longitudinal web sewn into the cover for dividing the cover into generally equal head section and neck section, the neck section having a given depth, the web providing a hinging action between head and neck sections in a way that the neck section is moveable from a horizontal to a hinged position and the head section remains horizontal, a neck recess in the neck section starting at spaced points on the long edge of the neck section and extending into the body of the neck section along arcuate lines to an apex located approximately one-half of the depth of the neck section, the neck recess defining neck lobes at the outer corners of the neck portion of the pillow cover, the neck recess further defining a neck roll pinched between web and apex and having a thickness less than that of the neck section, the neck roll together with the neck lobes attached along the longitudinal web to hinge with respect to the head section, the pillow cover being stuffed with filling to form a sleeping pillow whereby the neck portion of the pillow is moveable to hinged position to support a sleeper's neck positioned in the recess as the head portion remains horizontal to support a sleepers head.

3. A pillow for sleeping comprising a pillow cover having a generally rectangular shape defined by long edges and short edges, a longitudinal web sewn into the cover for dividing the cover into a generally equal head section and a neck section, the web providing a hinging action between head and neck sections in a way that the neck section is moveable from a horizontal to a hinged position and the head section remains horizontal, a neck roll in the neck section defined by a recess extending into the neck section along arcuate lines, the neck section further defining neck lobes on either side of the recess, neck roll pinched between web and apex and having a thickness less than that of the neck section, the pillow cover being stuffed with filling to form a sleeping pillow whereby the neck section of the pillow is moveable to hinged position to support a sleeper's neck positioned on the neck roll as the head portion remains horizontal to support a sleepers head.

4. A pillow as defined in claim 3 in which the pillow has a given depth, and in which depth of the neck roll is approximately one-half to three-quarters of the depth of the pillow.

5. A pillow as defined in claim 3 in which the recess arcuate lines are convex at junction of outer long margin of neck section.

* * * * *